US005364233A

United States Patent [19]

Benoit

[11] Patent Number: 5,364,233

[45] Date of Patent: Nov. 15, 1994

[54] IRRIGATION PUMP APPARATUS

[76] Inventor: Terry J. Benoit, Rte. 2, Box 214 E., Rayne, La. 70578

[21] Appl. No.: 114,440

[22] Filed: Aug. 30, 1993

[51] Int. Cl.[5] ..... F04B 17/06

[52] U.S. Cl. ..... 417/231; 417/234

[58] Field of Search ..... 417/231, 234; 415/206, 415/98, 102

[56] References Cited

U.S. PATENT DOCUMENTS

| | | | |
|---|---|---|---|
| 2,214,677 | 9/1940 | North | 103/218 |
| 2,698,583 | 1/1955 | House et al. | 103/103 |
| 2,744,465 | 5/1956 | Springer | 103/87 |
| 2,999,628 | 9/1961 | Crombie | 415/206 |
| 3,008,422 | 11/1961 | Crisafulli | 103/87 |
| 3,150,598 | 9/1964 | Ogles | 103/103 |
| 3,170,646 | 2/1965 | Springer | 241/276 |
| 3,308,764 | 3/1967 | Walker | 103/103 |
| 3,371,614 | 3/1968 | Crisafulli | 103/104 |
| 3,779,670 | 12/1973 | Crisafulli | 417/231 |
| 3,799,690 | 3/1974 | Klaas | 415/72 |
| 3,832,093 | 8/1974 | Shirek et al. | 417/231 |
| 3,915,594 | 10/1975 | Nesseth | 417/231 |
| 3,958,895 | 5/1976 | Brisson | 415/98 |
| 4,175,916 | 11/1979 | Crisafulli | 417/231 |
| 4,594,006 | 6/1986 | Depeault | 366/266 |
| 5,074,751 | 12/1991 | Sixsmith | 415/206 |

FOREIGN PATENT DOCUMENTS

| | | | |
|---|---|---|---|
| 1528890 | 1/1970 | Germany | 413/98 |

*Primary Examiner*—Richard A. Bertsch
*Assistant Examiner*—Alfred Basichas
*Attorney, Agent, or Firm*—Pravel, Hewitt, Kimball & Krieger

[57] ABSTRACT

A irrigation pump apparatus includes an elongated frame having a proximate end portion and a distal end portion. An elongated drive shaft extends along the frame and to the proximal and distal end portions. The drive shaft is adapted to be driven by a piece of farm machinery, such as a tractor having a power take off connectable to the drive shaft. A pump housing mounted at the distal end portion of the frame carries an impeller that rotates with the drive shaft during use. The pump housing has an impeller that provides an improved configuration with enhanced efficiency. The housing includes a baffle portion supported within the housing and adjacent the discharge outlet and having an upper end portion positioned adjacent a transversely side wall portion of the housing. The baffle forms an acute angle of about forty degrees to eighty degrees (40°-80°) with the adjacent transversely extending side wall portion of the housing and is generally perpendicular to the opposite portion of the housing.

8 Claims, 3 Drawing Sheets

IRRIGATION PUMP APPARATUS

BACKGROUND OF THE INVENTION

1. Field Of The Invention

The present invention relates to irrigation pumps and more particularly relates to an improved irrigation pump that includes a elongated frame that can have trailer wheels at one end portion thereof (or permanent mount), and a trailer tongue at the opposite end portion thereof for connection to a tractor. The wheeled end portion includes a housing having an impeller driven by rotary power from the tractor, and wherein an improved configuration of the housing and impeller provide increased efficiency.

2. General Background

One type of irrigation pump that has been used for a number of years in the farming industry is an elongated pump that comprises a structural frame, for example twenty to thirty feet (20'-30') in length, having an end portion with a tongue for connection to a tractor, and an opposite end portion that can be wheeled. The frame can be towed behind the tractor to a desired location, or installed permanently to an underlying support such as a concrete base or the like. Pumps of this type can be installed in place such as adjacent a pond or reservoir so that the farmer can pump water from the reservoir to a desired location.

Irrigation pumps of this type provide an elongated drive shaft that extends between the tongue end portion of the frame and the wheeled or pump end portion of the frame. A power take-off of a tractor can from a connection at a universal joint to the drive shaft portion of the pump.

The drive shaft portion extends the full length of the frame and extends to an impeller mounted within a housing at the end of the frame adjacent the wheels or spaced away from the tongue end portion. The housing provides one or more openings allowing water to flow into the pump housing and open channel fashion when the pump is submerged. Typically, the openings are adjacent the center of rotation of the pump impeller and often provided on both sides of the housing.

Prior art pumps of this type sold and used commercially with a short baffle have been provided adjacent the discharge, positioned at ninety degrees (90°) with respect to the discharge flow path of water exiting the pump.

SUMMARY OF THE PRESENT INVENTION:

The present invention provides an improved pump apparatus that provides improved efficiency over prior art pumps of the type. The apparatus includes an elongated frame having a proximate end portion and a distal end portion.

The elongated frame carries an elongated drive shaft that can be driven and which extends along the frame to the proximal and distal end portions of the frame. The proximal end portion of the drive shaft can be connected to a tractor such as at the power take off portion of the tractor. The distal end portion of the drive shaft drives a pump impeller. The pump provides a housing mounted at the distal end portion of the elongated frame, the pump having a transversely extending wall portion with first and second end portions and a pair of opposed side walls connected thereto, the side walls each being generally perpendicular to the drive shaft and at least one of the side walls having a side wall opening.

One of the side wall openings defines a flow inlet for the intake of fluid to be pumped when the pump housing is submerged at least sufficiently to submerge a portion of the flow inlet so that water or other fluid being pumped enters the pump housing interior via gravity flow.

The housing provides a discharge outlet surrounded by side walls and the first and second end portions of the transversely extending wall portion.

The drive shaft extends through the pump housing communicating with the side wall opening and defining a pump housing impeller axis.

A rotary impeller is generally circular in shape and is mounted for rotation with the pump drive shaft. The impeller can be keyed, welded, or otherwise attached to the drive shaft so that the impeller spins when the drive shaft is rotated using a tractor, for example.

The transverse wall portion of the housing includes a curved portion that extends around the impeller. A first baffle plate is supported within the housing adjacent the outlet and has an upper end portion positioned adjacent the transversely extending side wall and a second lower end portion that approaches the periphery of the impeller. The baffle forms an acute angle of between forty degrees and eighty degrees (40°-80°) with the adjacent transversely extending side wall and is preferably generally parallel to the opposite transversely extending side wall portion of the housing. A second curved baffle extends from the lower end of the first baffle to the pump transverse wall.

The above construction and configuration has been found to be highly efficient, with the pump efficiency approaching eighty-ninety percent (80%-90%). This represents an improvement over prior art type irrigation pumps that typically have an efficiency of well below fifty percent (50%).

BRIEF DESCRIPTION OF THE DRAWINGS:

For a further understanding of the nature and objects of the present invention, reference should be had to the following detailed description taken in conjunction with the accompanying drawings, in which like parts are given like reference numerals, and wherein.

Figures 1, 2:
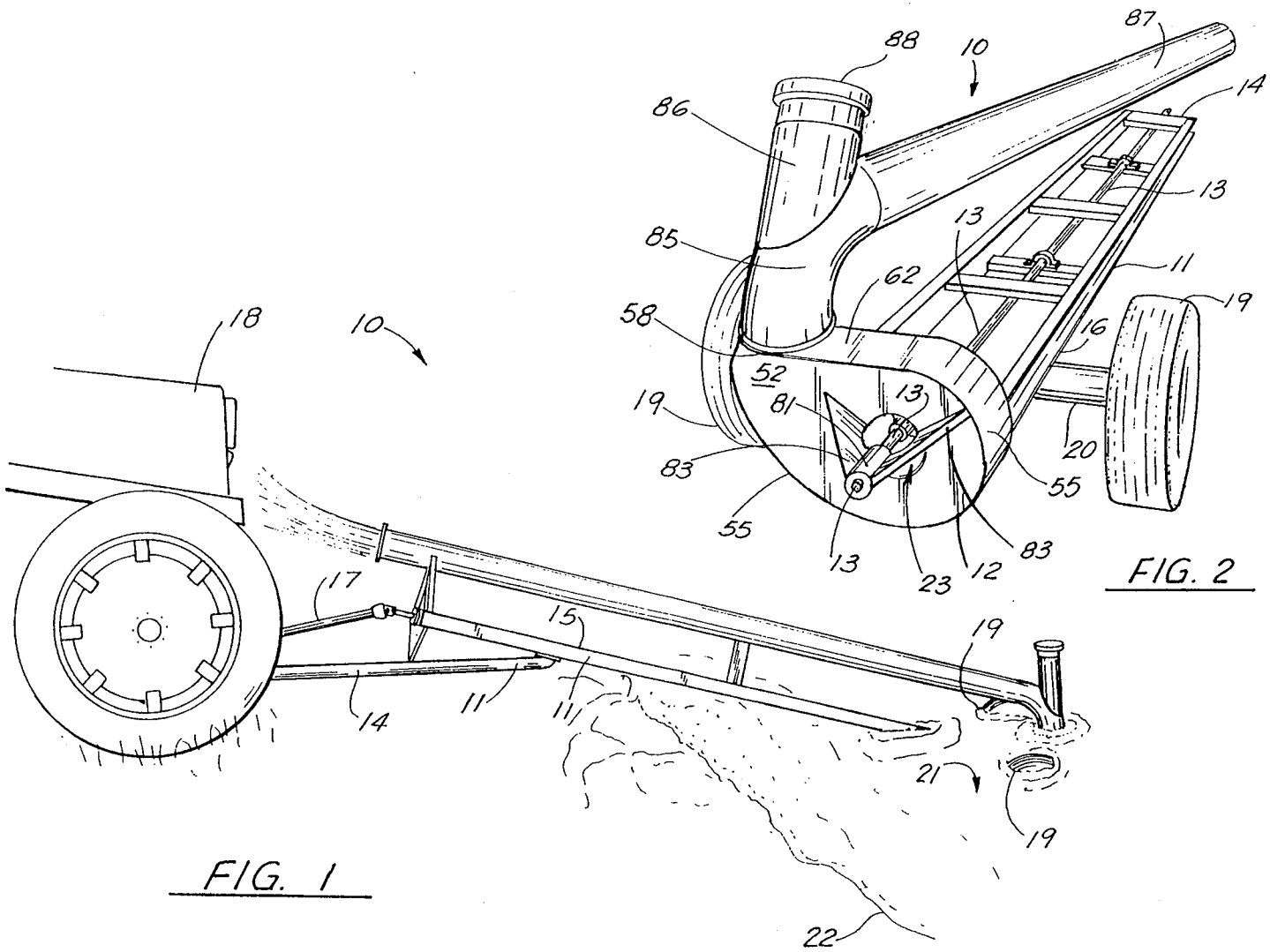
FIGS. 1-2 are perspective views of the preferred embodiment of the apparatus of the present invention.

DETAILED DESCRIPTION OF THE PREFERRED EMBODIMENT:

FIGS. 1-2 and 7-8 illustrate the preferred embodiment of the improved irrigation pump apparatus of the present invention designated by numeral 10. Irrigation pump apparatus 10 provides an elongated frame 11 having a housing 12 disposed at one end portion and a tongue end portion 14 for connection to a tractor 18 for example. An elongated drive shaft 13 extends the full length of the housing between the first end portion 15 and the second end portion 16 that carries housing 12. Universal joint 17 is used to form a rotary connection between the drive shaft 13 and the power take-off for example of a tractor 18.

Figure 8:
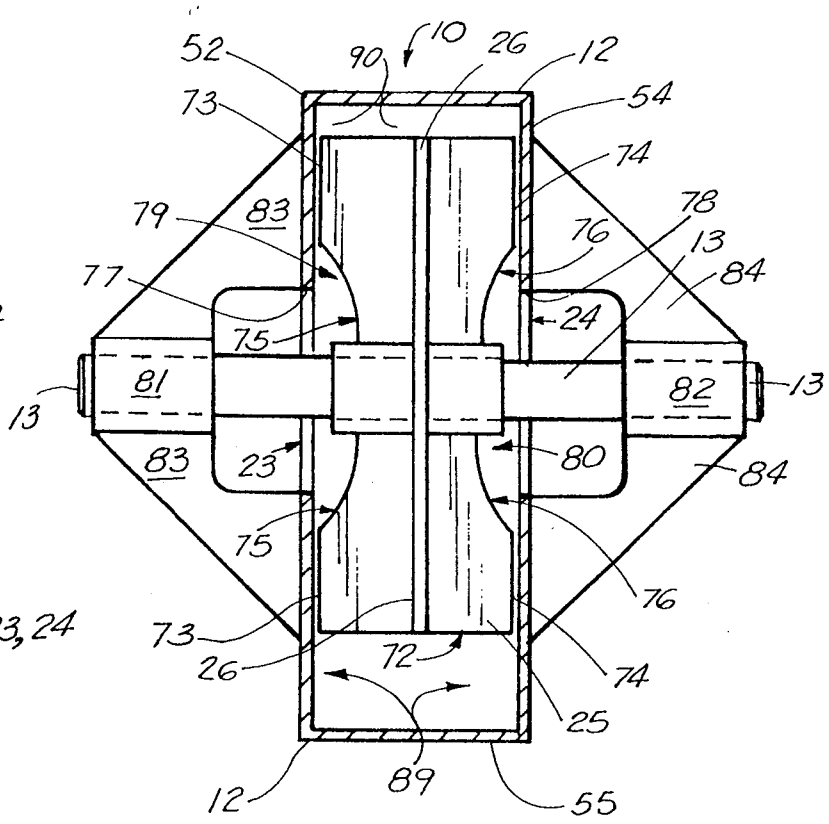
FIG. 8 is a sectional view taken along lines 8—8 of FIG. 7.
Figure 7:
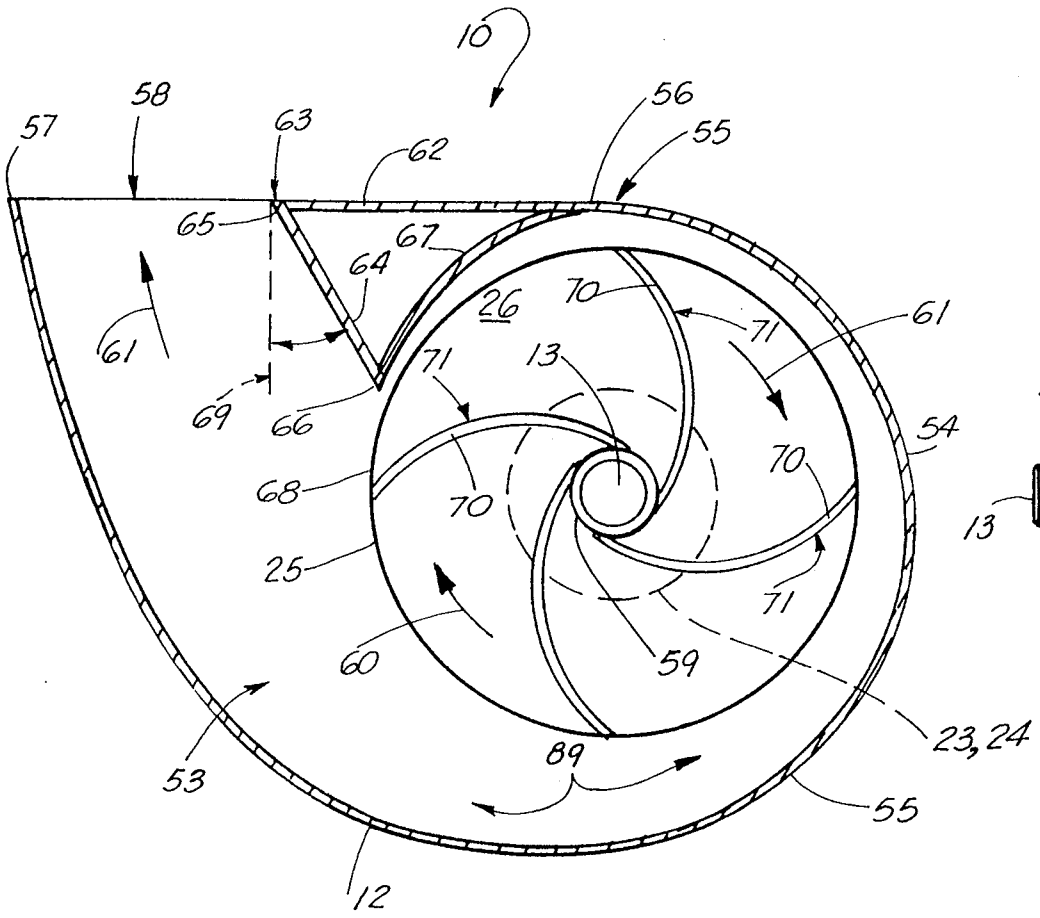
FIG. 7 is a sectional elevational, side view of the pump housing and impeller portion of the preferred embodiment of the apparatus of the present invention.

A pair of wheels such as inflatable tires 19 can be used to rotatively support the end portion of the frame at housing 12. The wheels can be mounted upon axle 20 which can be welded to frame 11. During use, wheels 19, end portion 16, and housing 12 are submerged (see FIG. 1) under the water surface 21 of a reservoir 22, pond or the like. In this fashion, water can flow from the reservoir 22 into the pump housing 12 via one or more flow inlets 23, 24 (FIGS. 2, 7–8).

The tongue 14 end portion of the frame 11 is above the water surface 21 and extends to tractor 18 which remains on dry land. The connections between tractor 18 and frame 11 and between universal joint 17 and tractor 18 are well know in the art.

During use, the operator powers drive shaft 13 with the power take-off unit of tractor 18. Rotation of the drive shaft 13 also results in a rotation of impeller 25. Impeller 25 includes a disk shaped body 26. The particular construction of pump housing 12 and impeller 25 will be discussed more fully hereinafter, following a discussion of prior art irrigation pumps known to applicant.

It should be understood that the general configuration of an irrigation pump apparatus that includes a frame 11, drive shaft 13, tongue 14, connection portion 17, wheels 19, and a housing is an old structure well known in the art. In FIGS. 3–6, two prior art versions of an irrigation pump apparatus are shown. In the first version of FIGS. 3 and 4, the prior art pump apparatus includes a housing 27 that contains a rotary impeller 28. The impeller 28 provides a plurality of circumferentially spaced vanes 29. The sides **29*a* of vanes 29 are slightly angled with reference to housing wall 32 as shown in FIG. 4. Impeller 28 is mounted for rotation upon drive shaft 30 which extends the full length of a frame (such as 11) that is connectable to a tractor 18. The drive shaft 30 is powered by the tractor and has a center of rotation 31 that is the same as the center of rotation of the impeller 28. The housing comprises an outer wall 32 and has a pair of flow inlets 33, 34 mounted on opposite sides of the housing, in communication with the drive shaft 30 and center of rotation 31 of the drive shaft 30 and impeller 28. Pump discharge opening 35 defines the outlet for water exiting the pump housing 27. Curved arrows 36 define the direction of rotation of impeller 28. Impeller can be joined to drive shaft 30 at cylindrical hub 38. Arrow 37 defines the direction of flow of water exiting pump at discharge 35**.

Figure 3:
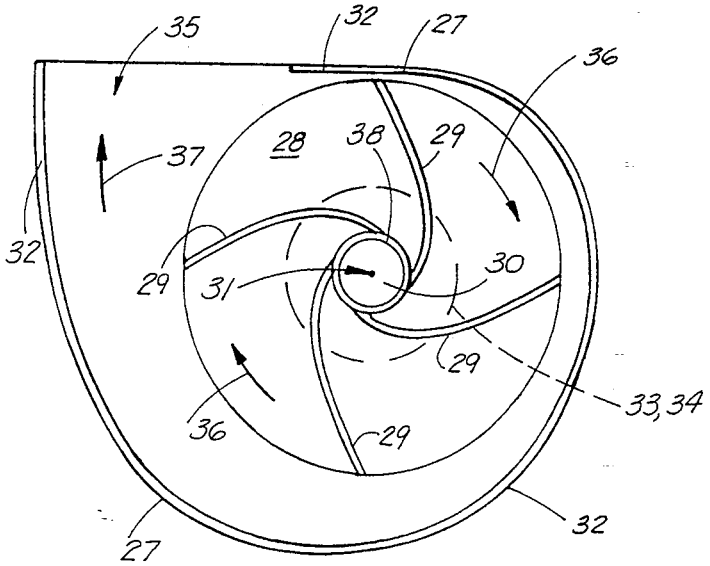
FIG. 3 PRIOR ART
FIG. 3 is a side sectional view of a prior art type irrigation pump.
Figure 4:
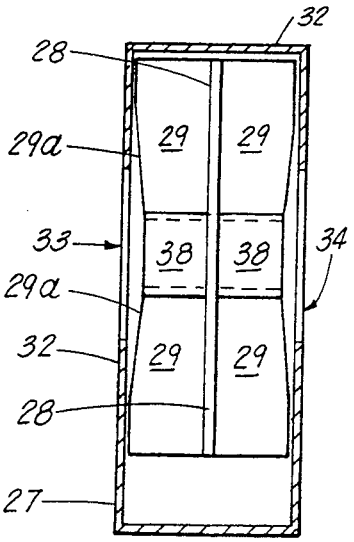
FIG. 4 PRIOR ART
FIG. 4 is a sectional view taken along lines 4—4 of FIG. 1 of a prior art type irrigation pump of FIG. 3.
Figure 5:
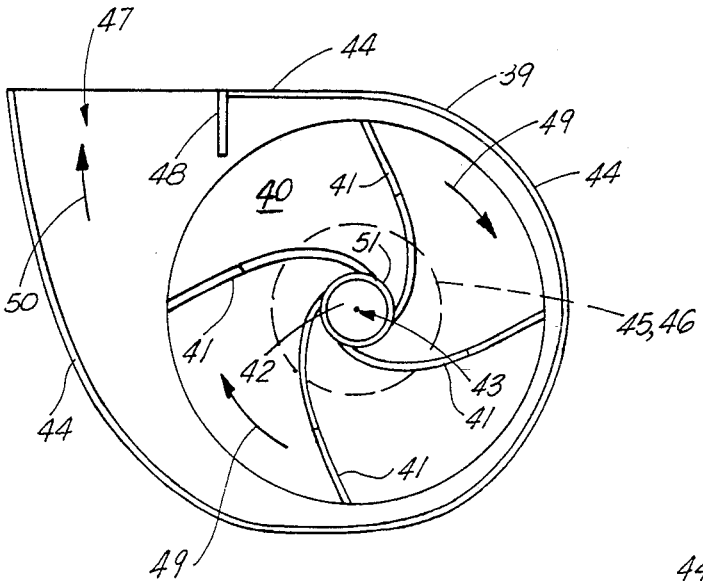
FIG. 5 PRIOR ART
FIG. 5 is a side sectional view of another Prior Art type irrigation pump that uses a baffle adjacent the pump discharge.
Figure 6:
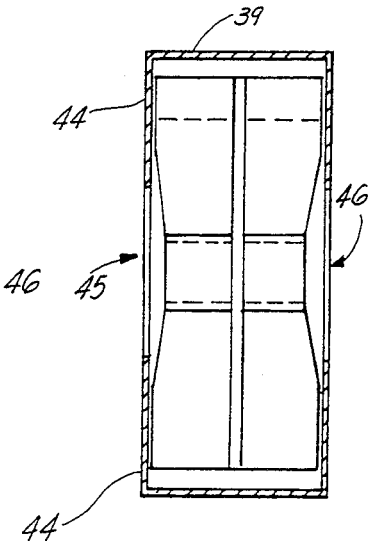
FIG. 6 PRIOR ART
FIG. 6 is a sectional view taken along lines 6—6 of FIG. 5 illustrating the prior art type irrigation pump of FIG. 5.

In FIGS. 3 and 4, another prior art version of an irrigation pump is shown. The prior art pump apparatus of FIGS. 5 and 6 includes a housing 39 with a rotary impeller 40 mounted therein upon drive shaft 42. Impeller 40 provides a plurality of circumferentially spaced vanes 41. In the drawings, 43 designates the center of rotation of the drive shaft 42 and impeller 40. The housing includes housing wall 44 having a pair of spaced apart flow inlets 45, 46 that communicate with the center of rotation 43 of the drive shaft. Discharge 47 defines an outlet for water leaving the pump housing 39. Baffle plate 48 forms a right angle with the discharge flow path, designated by arrow 50 in the drawings. Curved arrows 49 define the direction of rotation of impeller 40. Impeller 40 can be joined to drive shaft 30 at cylindrical hub 51.

In FIGS. 7 and 8, the preferred embodiment of the apparatus of the present invention designated generally as 10 shows a partial sectional view thereof including housing 12 with a housing interior 53 that includes generally flat side walls 52, 54 and curved side wall 55. Curved side wall portion 55 begins at a location 56 immediately above impeller 25 central hub 59 and preferably just above the center of rotation 60 of hub 59 and drive shaft 13. Curved side wall 55 terminates at a location 57 adjacent discharge outlet 58. Arrow 61 in FIG. 7 schematically shows the direction of flow at discharge outlet 58. Housing 12 also includes a straight side wall portion 62 that communicates with curved side wall 55 at location 56. A flat side wall portion 62 of housing 12 extends between curved side wall 55 at location 56, and terminating at discharge outlet 58 at location 63. A baffle plate 64 extends from flat side wall member 62 and downwardly toward impeller 25. The baffle 64 connects at its upper end portion 65 to flat side wall 62 at location 63. A lower end portion 66 of baffle 64 is positioned closely adjacent the outer periphery of impeller 25, as shown in FIG. 7. A curved baffle 67 has a curvature that approximates that of a curvature of impeller 25 at its periphery 68. Curved baffle 67 has a curvature that tracks the periphery 68 of impeller 25, beginning at position 66 and terminating at position 56, the intersection of curved side wall 55 and flat side wall portion 62, as shown in FIG. 7. Baffle 64 forms an angle of about twenty degrees–sixty degrees (20°–60°) with the line 69 that is perpendicular to flat side wall portion 62. Arrow 91 in FIG. 7 indicates the angle of thirty–fifty degrees (30°–50°) as preferred. The baffle 64 is generally parallel to the direction of flow 61 of fluid discharging pump apparatus 10. Further, the baffle 64 is generally parallel to curved wall 55 of pump housing at a position adjacent discharge outlet 58.

Impeller 25 includes a plurality of vanes 70. Vanes 70 are curved, each vane presenting a convex surface 71 to the upstream side of flow that is moving in the direction of arrow 60, 61. Each vane 70 has a transverse, linear surface 72 that communicates with the periphery 68 of impeller 25. A pair of spaced apart and generally parallel edge portion 73, 74 define edges of impeller 25 that intersect edge 72 at right angles. A plurality of concave surfaces 75, 76 communicate with edges 73, 74 respectively and hub 59, as shown in FIG. 8. Concave surfaces 75, 76 extend from hub 59 a distance beyond the periphery 77, 78 respectively of inlet openings 23, 24. The presence of concave edges 75, 76 produces an open area 79, 80 respectively adjacent inlets 23, 24 for allowing incoming fluid to efficiently flow into the pump in normal gravity flow situations. This provides for increased efficiency in operation of pump apparatus 10.

The use of baffle 64 and curved baffle 67 further provide increase in efficiency. Baffle 64 is angled as shown in FIG. 7 to be generally parallel to the direction of flow 61 exiting pump housing 12 at discharge 58. Baffle 64 extends transversely between side walls 52, 54 thus forming a dam against fluid flow exiting pump housing 12 at opening 58.

In FIG. 8, the impeller 25 is driven by drive shaft 59, keyed thereto for example. Drive shaft 13 is supported by bushings 81, 82. Each bushing is supported respectively by a plurality of circumferentially arranged support plates 83, 84.

Discharge opening 58 communicates with elbow 85. Elbow 85 can optionally be connected to a short discharge conduit 86 or to a long discharge outlet 87. Alternately, both short 86 and long 87 conduits can be provided as shown in FIG. 2, wherein the conduit 86 or 87 not in use can be sealed with pipe cap 88.

Impeller 25 is positioned within housing 12 interior 53 so that a free space 89 is provided below impeller 25 and opposite discharge 58, and a smaller free space 90 is provided above impeller 25 adjacent curved baffle 67. This positioning of an enlarged free space 89 below impeller 25 has been found to increase the efficiency of pump apparatus 10.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A pump apparatus comprising;

a) an elongated frame having a proximate end portion and a distal end portion;

b) an elongated drive shaft that extends along the frame between the proximal and distal end portions;

c) a pump housing mounted at the distal end of the elongated frame, the pump housing having a curved, transversely extending peripheral wall portion connected to a pair of opposed sidewalls, the sidewalls being generally perpendicular to the drive shaft, each sidewall having a sidewall opening defining a flow inlet for the intake of fluid to be pumped when the pump housing is submerged at least sufficiently to submerge each of the flow inlets;

d) the housing having a discharge outlet with an outlet periphery that is positioned between the sidewalls and communicating with the transversely extending wall portion;

e) the drive shaft extending through the pump housing at the sidewall openings, defining a pump housing impeller axis;

f) an impeller having an impeller periphery, the impeller mounted for rotation with the pump shaft;

g) the transverse wall including a curved portion that extends around the impeller and a pair of straight portions that extend away from the impeller to define an open space in the housing, near the outlet;

h) a baffle plate with first and second end portions supported within the housing adjacent the outlet, one end portion of the baffle being positioned adjacent the transverse wall at the outlet periphery, the baffle forming an acute angle with the adjacent transverse wall, the baffle plate second end portion being a free end portion positioned closely adjacent the periphery of the impeller, and spaced radially from the impeller, occupying a position that is between the impeller periphery and the transverse wall.

i) the baffle extending transversely between the side walls wherein the baffle is connected to each of the side walls and to the transverse wall to rigidify the housing at the discharge outlet.

2. The apparatus of claim 1 wherein the pump housing transversely extending wall portion includes a curved portion that extends from a position that begins vertically above the drive shaft and terminates at a position adjacent the discharge outlet.

3. The pump apparatus of claim 1 wherein the baffle plate is generally parallel to the transversely extending wall portion adjacent the discharge outlet.

4. The pump apparatus of claim 1 wherein the impeller includes a plurality of vanes circumferentially spaced along the impeller, each vane beginning at a position adjacent the drive shaft and each vane being positioned to present a convex surface to the direction of fluid flow within the pump housing.

5. The pump apparatus of claim 1 wherein there is further provided a curved baffle plate extending from the baffle plate to the transversely extending side wall and having a curvature that corresponds to the curvature of the periphery of the impeller.

6. The pump apparatus of claim 5 wherein the curved baffle plate is connected at one end portion to the pump housing transversely extending side wall and at its opposite end portion to the lower end portion of the baffle plate.

7. The pump apparatus of claim 1 wherein the pump impeller is positioned within the housing so that a free space is provided above and below the pump impeller, each free space being generally between the pump impeller and transversely extending side wall of the housing, and including an upper smaller free space and a lower larger free space.

8. The pump apparatus of claim 7 wherein the pump impeller is spaced a distance from the transversely extending side wall by a measure that gradually decreases in distance beginning at a position adjacent the bottom of the baffle plate and terminating at a position at least one hundred eighty degrees (180°) therefrom in a circumferential direction.

* * * * *